United States Patent [19]

Lee

[11] Patent Number: 5,019,682

[45] Date of Patent: May 28, 1991

[54] SEPARABLE ELECTRICAL COOKER

[75] Inventor: In B. Lee, Seoul, Rep. of Korea

[73] Assignee: Samsung Electronics Co., Ltd., Suweon, Rep. of Korea

[21] Appl. No.: 399,980

[22] Filed: Aug. 29, 1989

[30] Foreign Application Priority Data

Aug. 29, 1988 [KR] Rep. of Korea ..... 14058/88

[51] Int. Cl.[5] ..... H05B 6/12; E24C 15/10

[52] U.S. Cl. ..... 219/10.493; 219/10.67; 219/460; 126/21 A; 126/299 D

[58] Field of Search ..... 219/10.493, 10.67, 10.77, 219/10.55 R, 460, 400; 126/299 D, 21 A, 21 R

[56] References Cited

U.S. PATENT DOCUMENTS

| | | | |
|---|---|---|---|
| 3,627,986 | 12/1971 | Anderson | 219/460 |
| 4,241,718 | 12/1980 | Barnett | 126/21 R |
| 4,468,548 | 8/1984 | Yamaki | 219/10.493 |
| 4,549,052 | 10/1985 | Simon | 219/10.493 |
| 4,665,893 | 5/1987 | Miyagawa et al. | 219/10.493 |
| 4,899,028 | 2/1990 | Arai et al. | 219/10.493 |

FOREIGN PATENT DOCUMENTS

| | | |
|---|---|---|
| 59-74435 | 4/1984 | Japan . |
| 59-112134 | 6/1984 | Japan . |

*Primary Examiner*—Philip H. Leung

*Attorney, Agent, or Firm*—Stern, Kessler, Goldstein & Fox

[57] ABSTRACT

An electronics cooker of a separating type comprises a heating portion mounted on the upper of the cooker body and provided with at least one oven having the heating coil, an adjusting portion mounted adjacent to the heating portion with the air ventilating portion being extended at a plane identical thereto and then at a downward direction thereof, a fan and appropriate ventilation in the air ventilating portion to force the cooling air to be circulated in the heating portion, an oscillating portion having dual upper and lower compartments divided by the compartment wall, in which the operating parts of the oscillating source are arranged in the lower compartment, a fan and appropriate ventilation in the upper compartment to force the cooling air to cool the oscillating source in the lower compartment, and electrical connections between the heating portion, the adjusting portion and the oscillating portion.

2 Claims, 4 Drawing Sheets

SEPARABLE ELECTRICAL COOKER

FIELD OF INVENTION

The invention is related to providing an electronics cooker of a separating type having bodies which is divided into a heating portion, an adjusting portion and an oscillating portion, and particularly to providing an electronics cooker of a separating type having an improved cooling apparatus.

BACKGROUND OF INVENTION

A conventional electronics cooker was generally provided with a heating portion, an adjusting portion and an oscillating portion mounted integrally in one body. On the other word, the heating portion includes at least one burner in which a heating coil is properly arranged. The oscillating portion having the high frequency generating inverter is mounted directly under the heating coil, and also the adjusting portion is mounted near the heating portion.

Therefore, such like cookers have the body of the relative larger volume. Due to it, it is not easy to transport or install the cooker. When any one of a heating portion, an adjusting portion and an oscillating is becoming out of order, all parts of the cooker must be exploded, the amount of the repairing service is increased, while it takes the relative longer time in making for repair. Further, the super-heat emitted from the heating coil and the inverter is transferred to the adjusting portion adjacent to them, thereby influencing ill on the operation of the electronics cooker. In the worst case, the mal-function of the electronic cooker has been caused and the operating noise of the cooling fan has been occurred loudly.

Especially, in the event that the electronics cooker is provided with the cooling means, U.S. Pat. No. 4241718 issued to Eugene J. Barnett disclosed a structure of a range body cooling system for controlling the temperature of user accessible range body surfaces during a pyrolytic, oven-cleaning operation, in which a pair of downwardly extending, elongated channel members having U-shaped cross sections is positioned within the range body, one under each upper front corner thereof between a respective side wall of the range body and an opposed oven linear side wall, aperatured, horizontal mounting flanges from which the channel members are hung advantageously allow for the unimpeded upward flow of convected air along the entire lengths of the heat sink channel members. Herein, it is known that this patent concerns the spontaneous cooling using the convection phenomenon.

But, the heat sink member and the air flowing passages were arranged in the outer wall and at least one sides of the body, together or respectively. The grill structure for discharging the hot air was installed at one side of the adjusting portion or the predetermined area adjacent to the wall on which the cooker is positioned. Also, the inlet portion for intaking the cooling air to be circulated was established in opposition to the side of the adjusting portion. Due to it, it have been disadvantages that the volume of the applicance equipment is made big, its installing area is enlarged and the number of its parts is increased, thereby its assembly being difficult.

Japan Laid-Open Patent No. Sho 59112134 disclosed the structure for discharging the hot air, in which the heating cooker includes a cabinet for receiving its body, a discharging duct for emitting the hot air from its body, a discharging cover mounted between the discharging duct and the heating chamber wall on the upper portion of the discharging duct, the ventilating passage being formed between said discharging duct and said heating chamber wall. But this patent has also disadvantages identifying to those of U.S. Pat. No. 4241718.

Also, Japan Laid Open Publication No. Sho 59-74435 suggested that the cooker is provided with the high frequency oscillator and second heating source, such as the electrical heater or the burner, etc. and especially the shutter is mounted in the ventilating passage for acting to discharge the hot air from the heating chamber as well as to intake the cooling air from the outside, thereby opening or closing the ventilating passage according to the shape change based on the temperature of the shape memory alloy. For example, at least one ventilating passages are respectively formed at both sides and the rear side of the cooker, the fan is mounted at any one of both sides, and the shutter is mounted at the rear portion. Therefore, each of predetermined spaces for installing the cooling apparatus in the cooker must have been occupied at three sides, with a result that the whole volume of the cooker was enlarged. Herein, it is known that the prior art has been requested to assure the predetermined space for cooling the heating portion in at least one sides.

Accordingly, in order to resolve the above disadvantages, the main object of the invention is to provide the electronics cooker of the separating type, which is divided into the heating portion, the adjusting portion and the oscillating portion and may be adopted to anyone of the free standing range and the platform range.

The other object of the invention is to provide the electronics cooker of the separating type having the cooling means, in which the cooling means includes the air ventilating portion formed at only one side of the cooker, the adjusting portion arranged adjacent to the air ventilating portion the cooling fan mounted within air ventilating portion.

The another object of the invention is to provide the electronics cooker of the separating type having the other cooling means for cooling the operating parts of the oscillating portion, in which the oscillating portion is constructed as dual upper and lower compartment structures to force the cooling fan mounted in the upper compartment to circulate the cooling air intaked from the upper compartment into the lower compartment.

SUMMARY OF INVENTION

Thus, the invention can be adopted to the electronics cooker of the free standing type or the platform type and comprises a heating portion mounted on the upper of the cooker body and provided with at least one ovens having the heating coil, an adjusting portion mounted adjacent to the heating portion with the air ventilating portion being extended at a plane identical thereto and then at a downward direction thereof, cooling means mounted in the air ventilating portion to force the cooling air to be circulating in the heating portion, an oscillating portion having dual upper and lower compartments divided by the compartment wall, in which the operating parts of the oscillating source are arranged in the lower compartment, cooling means mounted in the upper compartment to force the cooling air to cool the osillating source in the lower compartment, and at least one means allowing the heating portion, the adjusting portion and the oscillating portion to be electrically connected to each other.

Therefore, the invention prevents the high temperature of the heating portion from transferring to the oscillating portion and the adjusting portion, so that it is not anxious about the ill influence on the oscillating portion or the adjusting portion, such as the mal-function of the heating portion and the poor operation of the adjusting portion.

Also, the invention is provided with two cooling means mounted to cool the heating portion and the oscillating portion, respectively, so that the cooling efficiency may be enhanced.

Also, the invention is provided with the heating portion and the oscillating portion separated from each other, so that the body of the heating portion may be thinner than that of the prior art to make an investigation for the variety of its design. And the ventilating portion formed in at least one sides of the cooker body is decreased by one side, so that the whole volume of the applicance equipment may be reduced.

BRIEF DESCRIPTION OF DRAWINGS

The above and other objects of the invention will be seen by the following description taken in connection with the accompany drawings, in which.

DETAIL DESCRIPTION OF INVENTION

Figure 3:
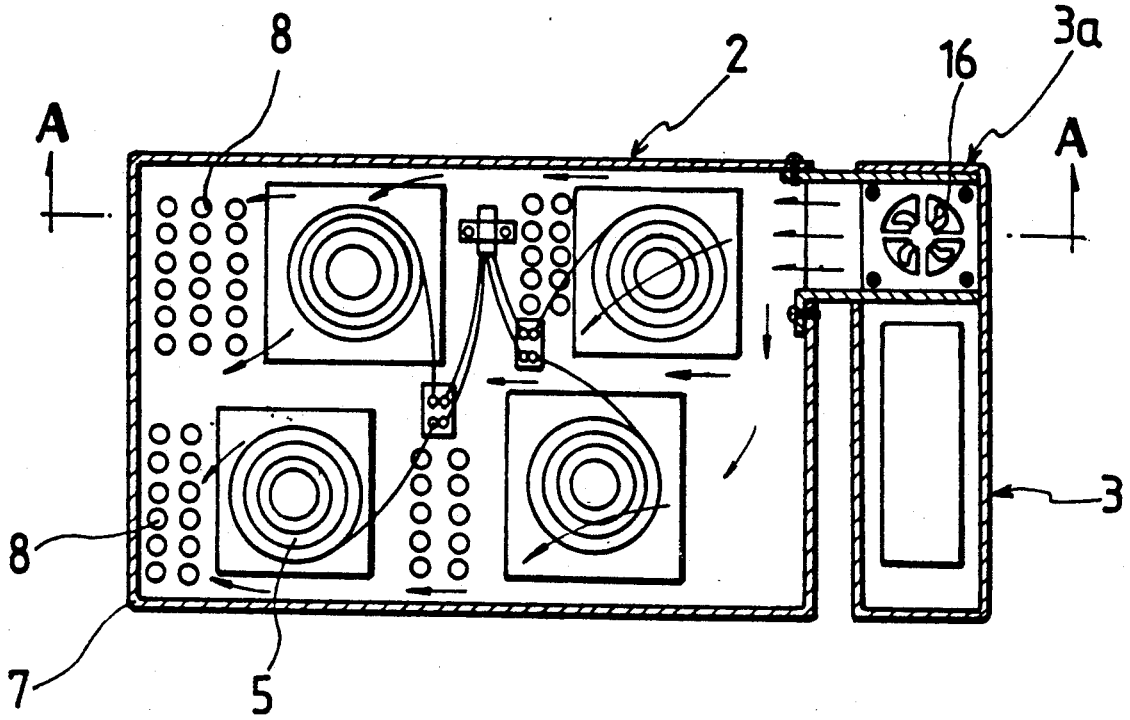
FIG. 3 is a upper plane view showing the heating portion, the adjusting portion and the cooling means constructed according to the invention.

In drawings, electronics cooker 1 is comprised of heating portion 2, adjusting portion 3 and oscillating portion 4. These heating portion, adjusting portion and oscillating portion are respectively constructed in their body. Heating portion includes case 7, in which at least one ovens having heating coil are properly arranged. Case 7 has numerous holes 8 perforated at its bottom throughout the predetermined area near each of oven 6 to discharge the air therefrom and cutting portion 9 formed at one side thereof to introduce the cooling air thereinto as shown in FIG. 3 and FIG. 4.

Figure 1:
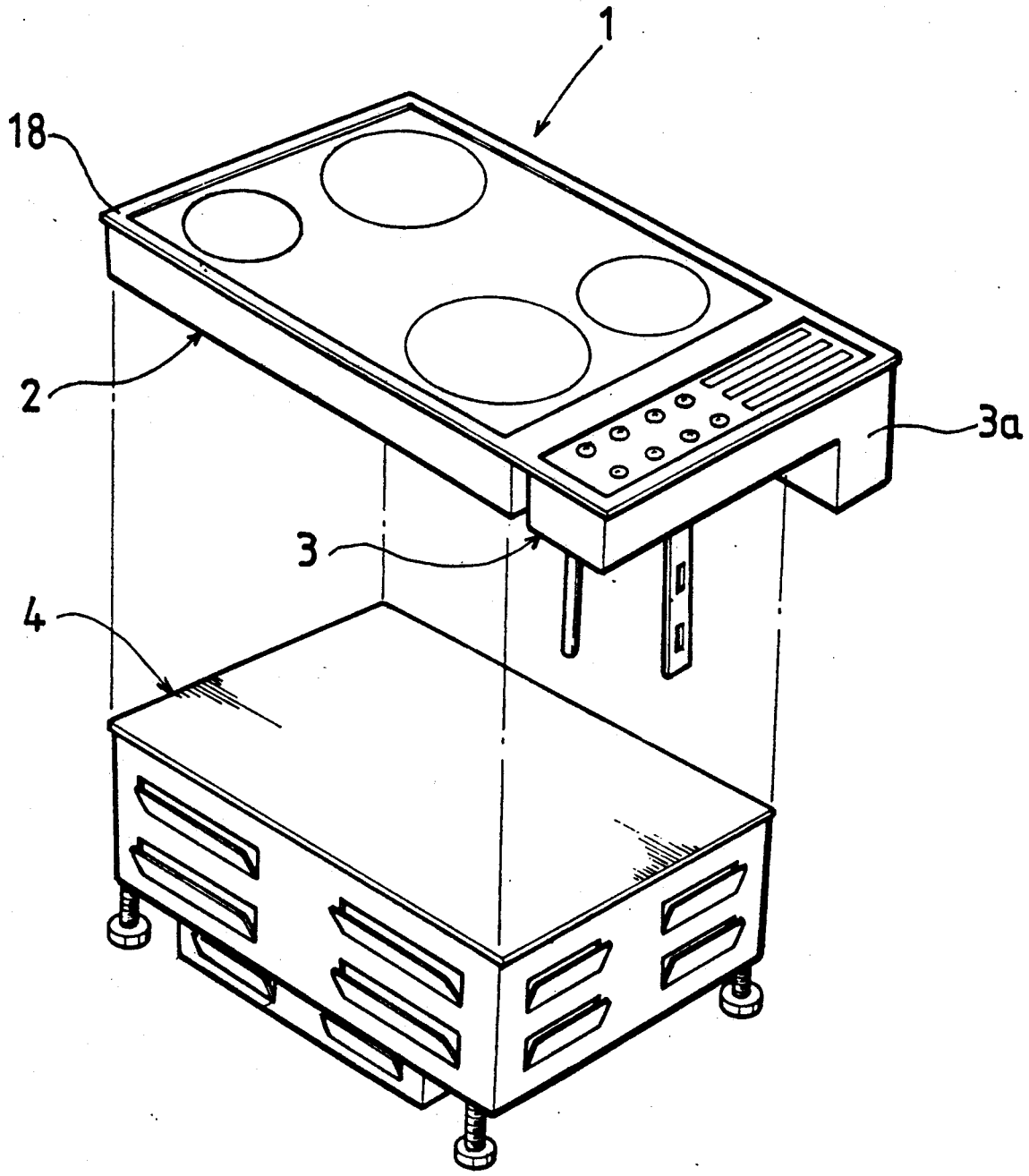
FIG. 1 is a perspective view showing the structure of the invention provided with the heating portion, the adjusting portion and the oscillating portion separated from each other.
Figure 2:
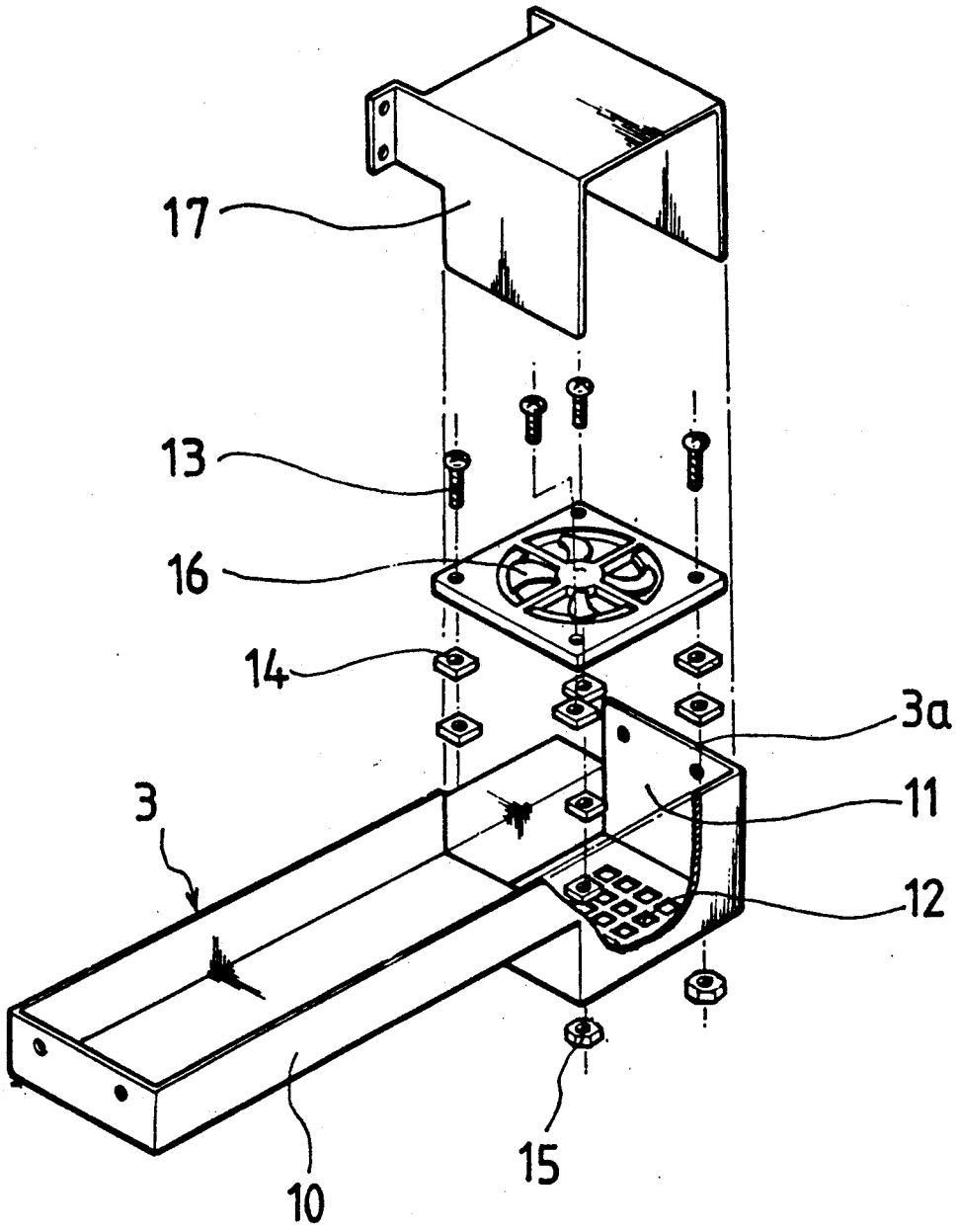
FIG. 2 is an exploded perspective view showing the cooling means and the adjusting portion constructed according to the invention.

Adjusting portion 3 is mounted adjacent to heating portion 2. As shown in FIG. 2, this adjusting portion 3 includes case 10 in the form of the scoop, the upper of which is opened. This case 10 has the cover provided with control knobs(not shown) for controlling the on-off time and the heating time of the applicance equipment and the heating level and PCB(not shown) mounted therein. On the other hand, air ventilating portion 3*a* is constructed adjacent to adjusting portion 3 with its predetermined length being extended downward below adjusting portion 3. Thus the inner portion of air ventilating portion 3*a* is formed as air ventilating passage 11, and its bottom is formed as inlet portion 12 for intaking the cooling air from the outside. Fan 16 serving as the cooling means is properly mounted in air ventilating passage 11 by means of bolts 13 having the predetermined length, pieces 14 and nuts 15. Air ventilating portion 3*a* is cut out at one side of the area corresponding to adjacent to cutting portion 9 of heating portion 2. Air flowing guider 17 is covered on the upper of air ventilating portion 3*a* to separate adjusting portion 2 therefrom with its end being extended from cutting portion 9 into heating portion 2.

Figure 4:
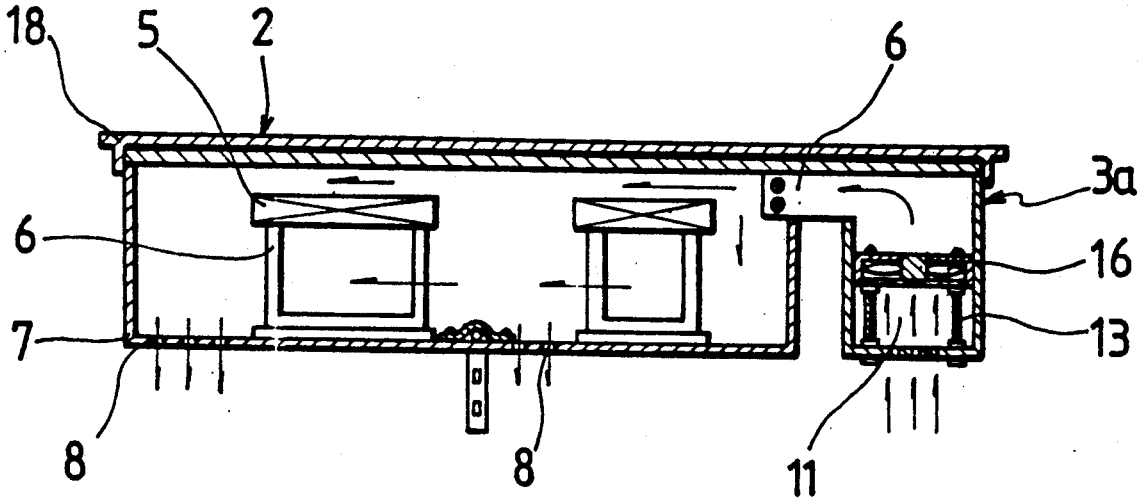
FIG. 4 is a side cross-sectional view taken out along line A—A of FIG. 3.

Therefore, as shown in FIG. 4, adjusting portion 3 is fixed by mounting 18 to adjacent heating portion 2, so that the cooling air intaked from air ventilating passage 11 by fan 16 is passed through the inner of heating portion 2 and then discharged from holes 8 to cool heating portion 2. Mounting 18 made by stainless steel is covered on the upper of heating portion 2 and adjusting portion 3.

Figure 5:
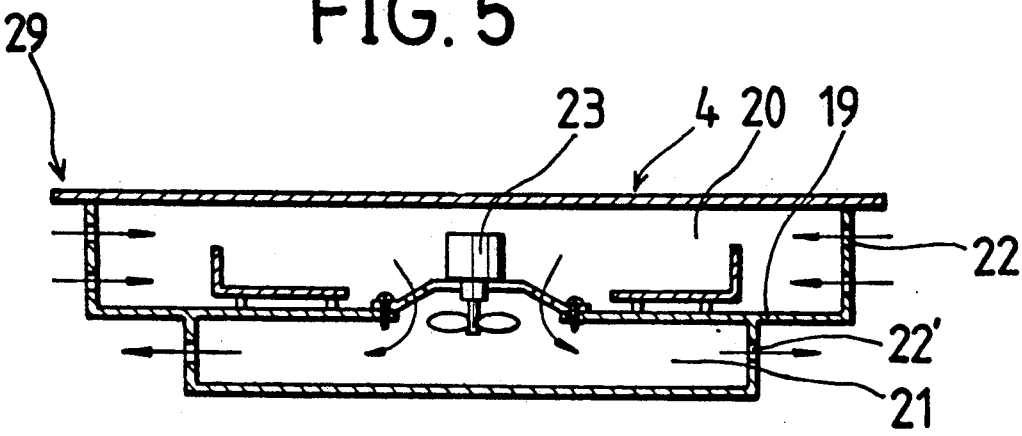
FIG. 5 is a side cross-sectional view showing the oscillating portion having the cooling means in its upper compartment according to the invention.

As shown in FIG. 5, oscillating portion 4 includes case 29 having dual compartments into which is divided by compartment wall 19. Upper compartment 20 is slightly larger than lower case 21, all sides of which is formed as inlet portion 22 for intaking the cooling air. Also upper compartment is provided with fan 23 installed properly in its inner space relative to the center of compartment wall 19, where the air blowing hole is perforated. Lower compartment 21 is provided with electrical parts of the oscillating source mounted therein, such as PCB, the magnatron and the transformer (not shown), etc. and outlet portion 22' formed at its sides to allow the cooling air intaked from upper compartment 20 to be discharged through outlet portion 22', thereby cooling oscillating portion 4. On the other hand, heating portion 2, adjusting portion 3 and oscillating portion 4 are electrically connected through leading wire 24 and connection line 25 to each other.

Figure 6:
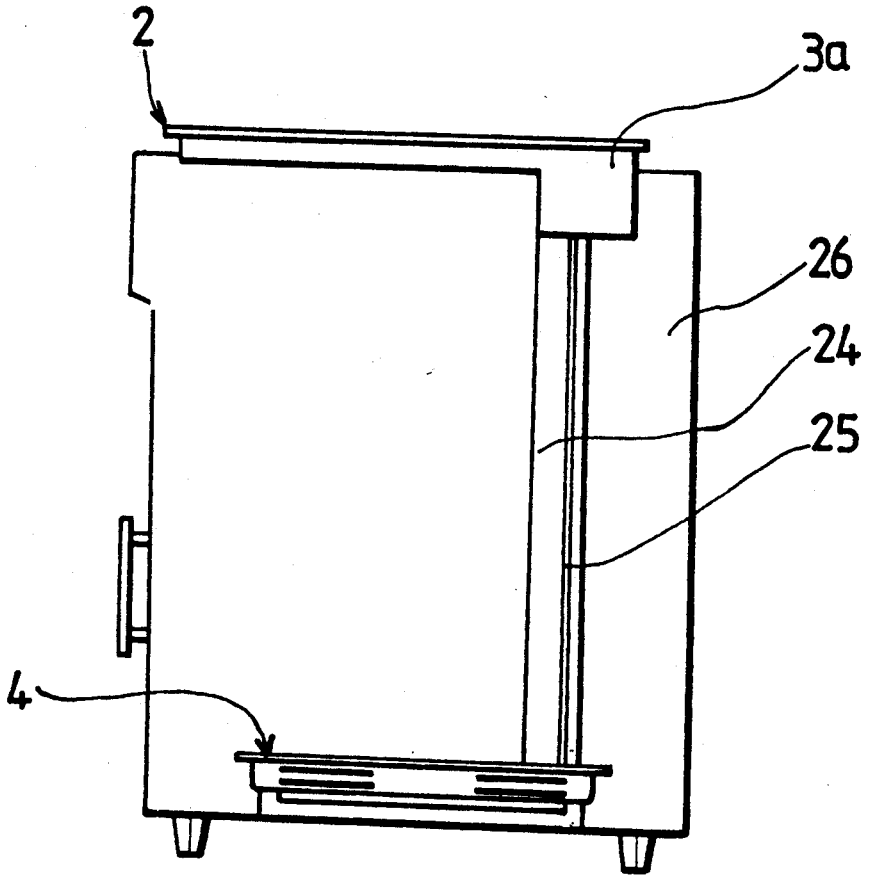
FIG. 6 is a side cross-sectional view showing the configuration of the invention adopted to the free-standing electronics cooker.

Therefore, in the case that the invention is adopted to the free standing electronics cooker as shown in FIG. 6, each of heating portion 2 and oscillating portion 4 may be installed at upper and lower sides of sink 26 using the inner space of the body with being separated from each other. In the case that the invention is adopted to the platform type cooker, heating portion 2 and oscillating portion 4 assembled, respectively, may be properly fixed to each other with being separated.

As described above, the invention has the separated body corresponding to each of parts, so that the body may be made thin to facilitate their transportation and installment.

The invention has at least one cooling means for cooling the heating portion and the oscillating portion, respectively, so that the cooling efficiency may be enhanced.

Also, the invention can allow the user to easily be accessible to the body of each parts and remove the interference on the adjusting portion due to the high temperature and the oscillating frequency caused by the heating portion and/or the oscillating portion, so that the body to be repaired may be easily exploded and repaired as well as the operation of the applicance equipment may be smoothly performed.

What is claimed is:

1. An electrical cooker composed of separable parts comprising:

a body;

a heating portion mounted at a first part of said body containing at least one heating coil;

an adjusting portion mounted adjacent to said heating portion;

means disposed on said adjusting portion for controlling said at least one heating coil;

an air ventilating portion adjacent said adjusting portion, a first part of said air ventilating portion extending substantially parallel to said heating portion and a second, contiguous part extending at an angle to the first part in the direction of a second part of said body;

a first cooling means mounted in said air ventilating portion for forcing air into said heating portion;

an oscillating portion mounted at said second part of said body and including first and second compartments separated by a compartment wall;

oscillating means arranged in said first compartment for operating said at least one heating coil;

a second cooling means mounted in said second compartment for forcing air to cool said oscillating portion; and connection means for electrically connecting said heating portion, said adjusting portion and said oscillating portion, whereby said heating portion, said adjusting portion and said oscillating portion are separable from each other.

2. The apparatus of claim 1 wherein said heating portion further includes first openings in a side of said heating portion adjacent to said adjusting portion for facilitating air flow into said heating portion, and second openings in a side of said heating portion facing said second part of said body for facilitating air flow out of said heating portion.

* * * * *